US005209223A

United States Patent [19]

McGorry et al.

[11] Patent Number: 5,209,223

[45] Date of Patent: May 11, 1993

[54] SINGLE CHAIR MUSCLE EXERCISE AND REHABILITATION APPARATUS

[75] Inventors: Raymond W. McGorry, Bayport, N.Y.; Aldo Sori, Wallington, N.J.

[73] Assignee: Biodex Medical Systems, Inc., Shirley, N.Y.

[21] Appl. No.: 960,296

[22] Filed: Oct. 13, 1992

Related U.S. Application Data

[63] Continuation of Ser. No. 672,181, Mar. 20, 1991, abandoned.

[51] Int. Cl.[5] ..... A61H 1/02

[52] U.S. Cl. ..... 128/25 R; 128/25 B; 482/4; 482/100; 482/133; 482/142; 482/908

[58] Field of Search ..... 128/25 R, 25 B; 482/1, 482/4, 52, 55, 57, 70–72, 75, 100, 133, 142, 901, 908; 73/379

[56] References Cited

U.S. PATENT DOCUMENTS 4,333,340 6/1982 Elmeskog ..... 73/379

4,511,137 4/1985 Jones ..... 482/100

4,765,615 8/1988 Case ..... 482/908 X

FOREIGN PATENT DOCUMENTS 0251656 1/1988 European Pat. Off. ..... 128/25 R

*Primary Examiner*—Richard J. Apley

*Assistant Examiner*—Joe H. Cheng

*Attorney, Agent, or Firm*—Peter T. Cobrin; Marvin S. Gittes; Richard I. Samuel

[57] ABSTRACT

A muscle exercise and rehabilitation apparatus including a patient chair having a first side and a second side is disclosed. Structure is provided for the rehabilitation and exercise of a patient seated in the patient chair. Structure is provided to move the rehabilitation and exercise structure between a first position adjacent the first side of the patient chair and a second position adjacent the second side of the patient chair in a first linear path. Structure is provided to support the patient chair for movement along a second linear path toward and away from the exercise and rehabilitation structure.

2 Claims, 8 Drawing Sheets 74
66
66a
123
128
120
134
134a
132a
132
126
127
130
115a
151
144
138
137
139
143
145
135
146
134b
149
133
141
147
125
124
129

SINGLE CHAIR MUSCLE EXERCISE AND REHABILITATION APPARATUS

This is a continuation of application Ser. No. 07/672,181 filed Mar. 20, 1991, now abandoned.

BACKGROUND OF THE INVENTION

This invention generally relates to a muscle exercise and rehabilitation apparatus and more particularly to a muscle exercise and rehabilitation apparatus that utilizes a single patient chair where the patient chair and the apparatus powerhead can each be independently moved to a desired position and orientation so that the patient chair can be placed in a large number of locations and orientations relative to the powerhead.

In U.S. Pat. No. 4,628,910 a muscle exercise and rehabilitation apparatus is disclosed in which a person's knee can be rehabilitated but no other limbs. The muscle exercise and rehabilitation apparatus of U.S. Pat. No. 4,628,910 discloses a chair upon which a patient sits while his leg is strapped to a handle. The muscle exercise and rehabilitation apparatus of U.S. Pat. No. 4,628,910 was distributed in 1985 by Biodex Corporation, the assignee of the instant application, and known as the B-1000. While the B-1000 had certain additional circuit features in it not disclosed in U.S. Pat. No. 4,628,910, it generally conformed to the description contained in this patent.

In U.S. Pat. No. 4,691,694, also owned by Biodex Corporation, an improved muscle exercise and rehabilitation apparatus is disclosed. In the muscle exercise and rehabilitation apparatus of U.S. Pat. No. 4,691,694, a dual chair arrangement is shown for an apparatus that is capable of rehabilitating and exercising a plurality of joints and limbs. The apparatus of U.S. Pat. No. 4,691,694 was known as the B-2000 and first distributed in 1986. While the apparatus of U.S. Pat. No. 4,691,694 has been widely sold throughout the United States and is suitable for its intended purpose of rehabilitating and exercising different joints of a person, it has two chairs and requires that a patient, who is exercising and rehabilitating one leg and wishes to exercise and rehabilitate the other leg, must first dismount from the chair he is sitting on and mount the other chair before exercise and rehabilitation of the other leg can commence. While this sounds simple enough, it can be a difficult procedure for a person who is injured and not fully ambulatory.

Muscle exercise and rehabilitation apparatus of the kind disclosed in U.S. Pat. No. 4,691,694 is used by hospitals, physical therapists, sports clinics, etc. Frequently, space is at a premium in these establishments and while the muscle exercise and rehabilitation apparatus of this patent satisfactorily rehabilitates and exercises various joints and limbs of a person, nevertheless because of its dual chair arrangement it occupies a significant amount of space.

It is also desirable that there be an infinite number of positions and orientations of the muscle exercise and rehabilitation apparatus chair relative to the powerhead so that a physical therapist will have a wide variety of such relative positions and orientations to choose from when providing physical therapy for an individual.

There is presently on the market a muscle exercise and rehabilitation machine known as the OSCER, which is an acronym for OPTIMUM SYSTEM FOR CONTROLLED EXERCISE AND REHABILITATION. The OSCER is manufactured and sold by Chattecx Corporation, which is a part of the Chattanooga Group located in Chattanooga, Tenn. With the OSCER, a chair is provided which can be raised and lowered as required. A powerhead unit to which an exercise arm is attached is fixed on a support structure so that it can swivel relative to the chair. However, the powerhead cannot be moved linearly toward or away from the chair.

A further muscle exercise and rehabilitation apparatus on the market is manufactured by Loredan Biomedical, Inc. and is known as the LIDO Active. The LIDO Active includes a bench system having a flat bench that "breaks" in the middle. However, the LIDO Active does not allow rotation of the bench relative to the powerhead.

It is an object of the present invention to provide a muscle exercise and rehabilitation apparatus having a single chair wherein the chair can assume a large number of positions and orientations relative to the powerhead.

Another object of the present invention is to provide a muscle exercise and rehabilitation apparatus having a single chair wherein the apparatus utilizes a minimum amount of floor space.

A further object of the present invention is to provide an improved muscle exercise and rehabilitation apparatus wherein, during the course of physical therapy for a patient, a physical therapist will have a great number of positions in which to place the chair relative to the apparatus.

Other objects of the invention will be apparent to those of ordinary skill in the art.

In accordance with the present invention, a powerhead and controller are utilized which are identical to those described in U.S. Pat. No. 4,691,694, the specification of which is incorporated herein by reference. The powerhead is mounted on a powerhead support stand and can be selectively elevated, lowered or rotated as required. The base of the powerhead support stand is mounted for linear movement on a powerhead support guide. Means is provided to allow the powerhead support stand to move along the length of the powerhead support guide in opposite directions and to a desired location.

Perpendicular and affixed to the powerhead support guide is a chair support guide and slidable thereon is a chair support. Mounted at the top of the chair support is a single chair. The chair support allows the height of the chair to be raised or lowered as desired and also allows the chair to be rotated.

In use, a patient is strapped onto the chair and if the patient is exercising and rehabilitating his right leg, the right leg will be strapped to the exercise arm which is driven by the powerhead. The physical therapist will select the appropriate height of the chair, the appropriate rotation of the chair and the distance from the powerhead to the chair. The position of the powerhead on the powerhead support guide, the powerhead height and degree of rotation of the powerhead on the powerhead support stand will also be selected by the physical therapist, all so that the person's right leg can be properly exercised and rehabilitated.

After the person has completed exercising and rehabilitating his right leg, the powerhead and powerhead support stand will be moved along the powerhead support guide so as to be located outside the person's left leg. The person's left leg will then be strapped to the exercise arm and he will exercise and rehabilitate his left leg, all of this occurring without the patient having to leave the chair.

By having the powerhead capable of moving along the powerhead support guide and the chair capable of moving along the chair support guide, a large number of positions and orientations of the chair relative to the powerhead can be obtained so that the optimal position for any patient can be utilized.

BRIEF DESCRIPTION OF THE DRAWINGS

In the drawings, wherein like parts are represented by the same reference numerals throughout the drawings.

DESCRIPTION OF THE PREFERRED EMBODIMENTS

Figure 1:
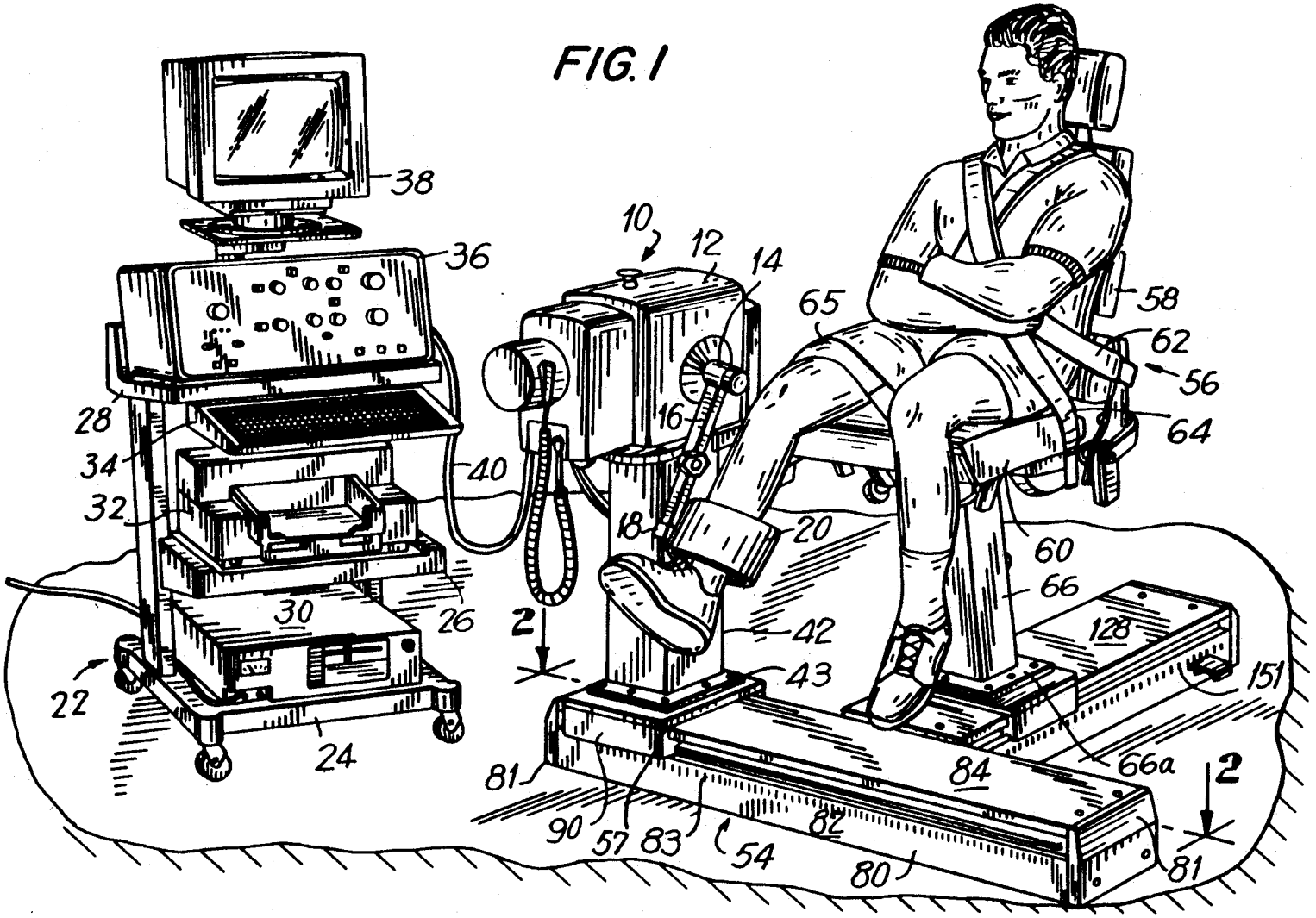
FIG. 1 is a perspective view of a muscle exercise and rehabilitation apparatus utilizing the chair arrangement of the present invention.
Figure 7:
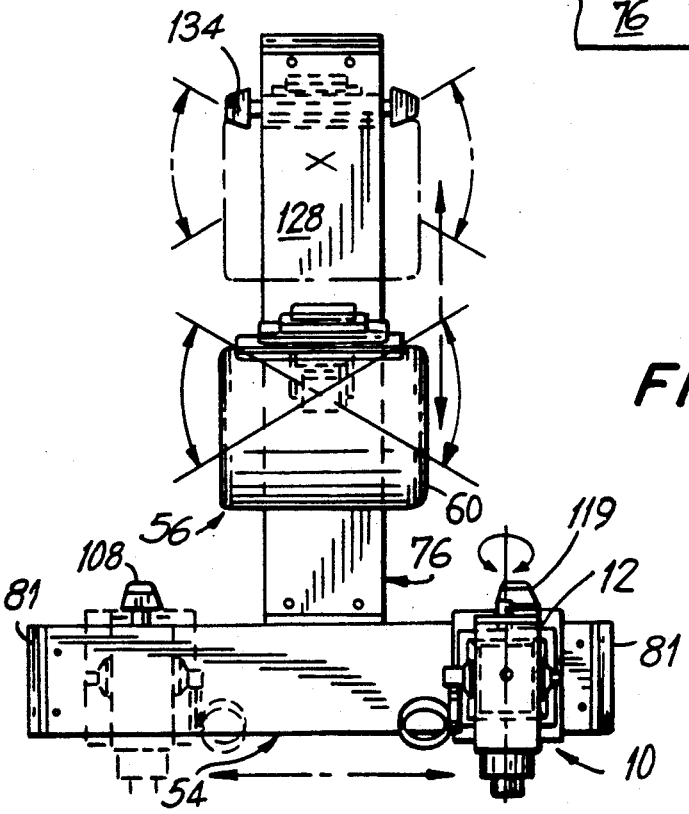
FIG. 7 is a top plan view illustrating relative movement between the powerhead and the patient chair.

In FIG. 1 of the drawings, a muscle exercise and rehabilitation apparatus 10 is disclosed and is of the type shown in U.S. Pat. No. 4,691,694 insofar as the electro and electromechanical servo systems. However, the chair arrangement is entirely different, as will hereinafter be described. Muscle exercise and rehabilitation apparatus 10 includes a powerhead 12 and a gearbox output shaft (control element) 14. The gearbox output shaft 14 of powerhead 12 projects outwardly from the right side of the powerhead, as shown in FIG. 1, and an identical shaft (as shown in FIG. 7) projects outwardly from the left side of powerhead 12. Rotatable with shaft 14 is a fixture 16 which has a handle 18 at the free end thereof. Affixed to handle 18 in FIG. 1 is a leg cuff 20 but it is to be appreciated that other exercise and rehabilitation implements could likewise be affixed thereto or to gearbox output shaft 14.

Inasmuch as the powerhead 12 and associated control apparatus are described in U.S. Pat. No. 4,691,694, the entire disclosure of which is incorporated herein by reference, there is no need to describe the functions and manner of operation of the powerhead other than to note, as will hereinafter be described with more particularly, that the powerhead can yaw upon its yoke-shaped support.

A cart 22 is positioned next to powerhead 12 and has shelves 24, 26 and 28. Located on cart 22 are the controls and data acquisition computer associated with the muscle exercise and rehabilitation apparatus 10. More particularly, located on shelf 24 is a computer 30, on shelf 26 a printer 32 and on shelf 28 the controller 36 for powerhead 12. Details of the controller are provided in U.S. Pat. No. 4,691,694. Affixed to the cart and located above controller 36 is a display screen 38. Keyboard 34 is supported by a shelf (not shown in the drawings) affixed to the bottom of shelf 28 of cart 22 or by some other conventional manner.

A cord 40 extends from controller 36 to powerhead 12 and serves to control the operation of powerhead 12 and the muscle exercise and rehabilitation apparatus 10 as disclosed in U.S. Pat. No. 4,691,694.

Figure 6:
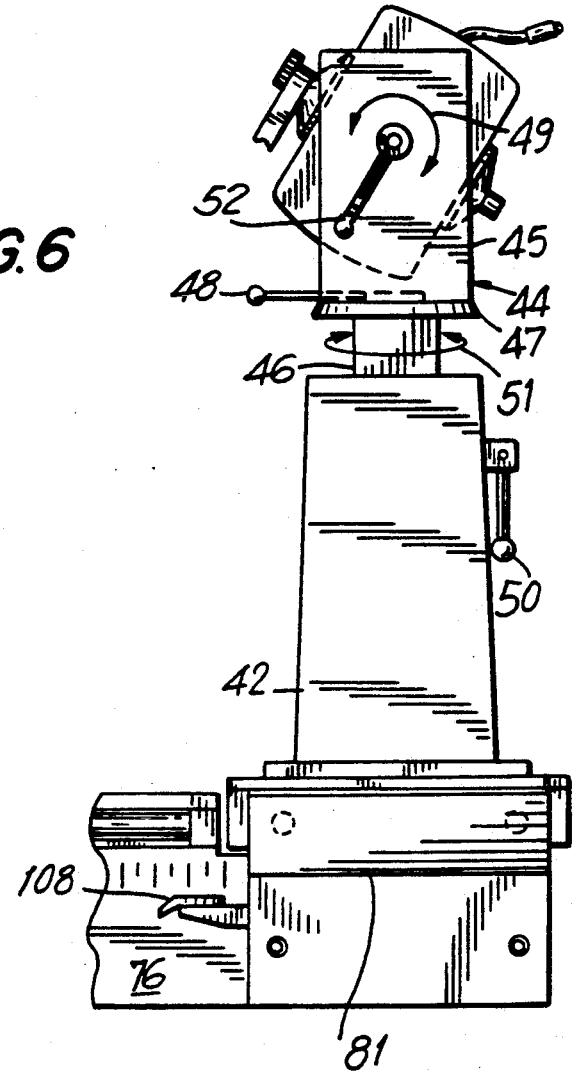
FIG. 6 is a side plan view illustrating how the powerhead may be positioned.

Powerhead 12 is mounted on a powerhead support stand 42 which can raise or lower the powerhead, as will hereinafter be described. Attached to a shaft 46 (FIG. 6) which extends from the top of powerhead stand support 42 is a bracket 44 having a bearing mounting which has leg 45 and base 47. Powerhead 12 has a bearing shaft which is rotatable in leg 45 and allows the powerhead to rotate as shown by arrow 49. Shaft 46 can rotate in yaw, as illustrated by the arrow 51 (FIG. 6), which rotation is controlled by a lever arm and clamp arrangement 48. A further lever arm and clamp arrangement 50 controls the extension of shaft 46 from powerhead support stand 42 and hence the elevation of the powerhead above ground.

An additional lever arm and clamp arrangement 52 is provided which controls the tilt of powerhead 12 in bracket 44.

Powerhead support stand 42 is movable along the length of powerhead support guide 54 in a manner that will hereinafter be discussed.

A patient chair 56 is provided and includes a back 58 and a base 60, as well as straps 62 and 64 for strapping a person's torso to the chair. Strap 65 is for strapping a person's leg to the chair. Chair 56 is mounted on a chair support stand 66 which can raise or lower the chair relative to the ground.

Figure 4:
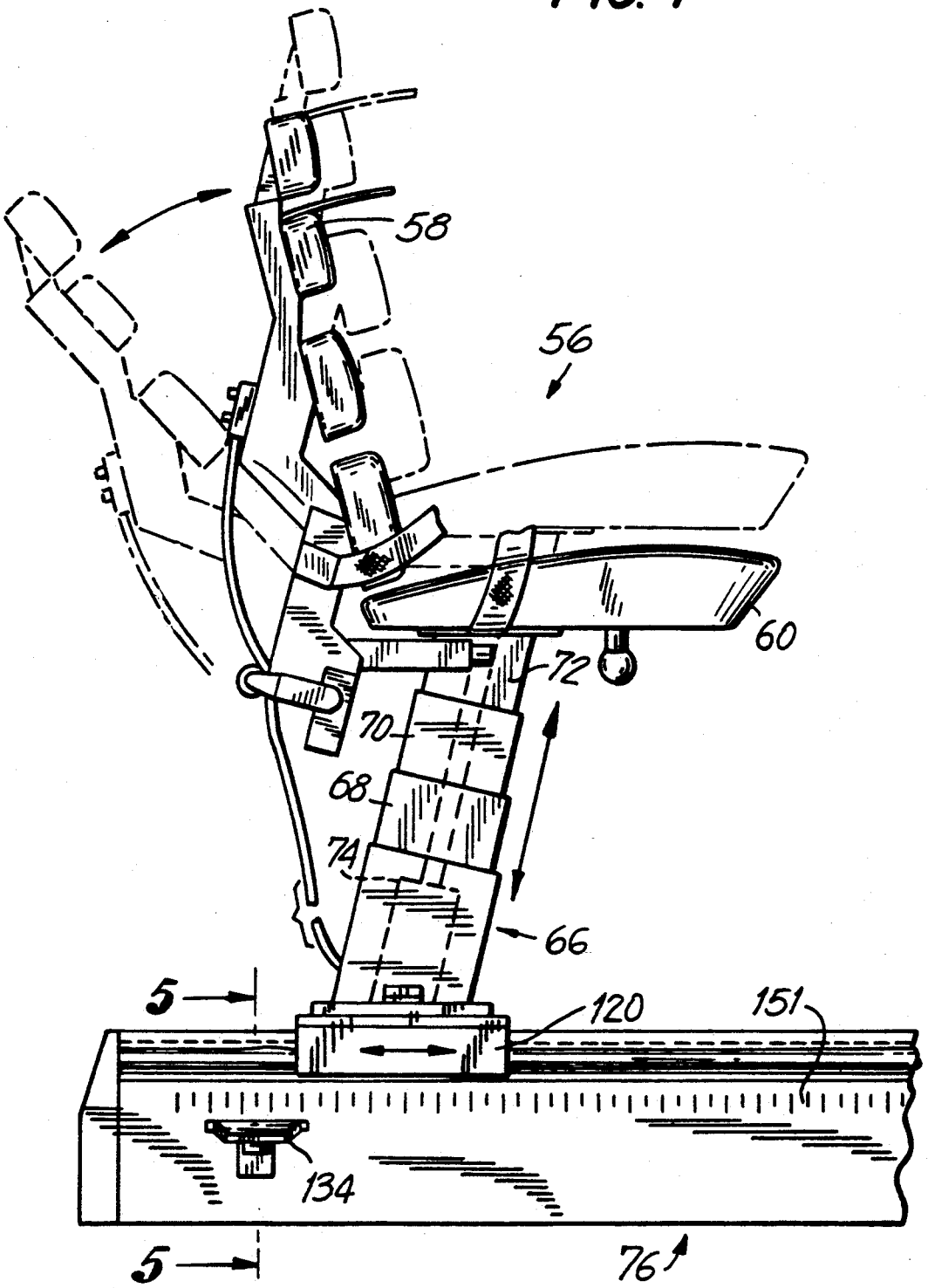
FIG. 4 is a side plan view of a patient chair on a chair support guide according to the present invention.

As best seen in FIG. 4, chair support stand 66 includes a plurality of telescoping sections 68, 70 and 72 which can, under the control of an electric motor 74, telescope relative to each other to either raise or lower chair 56. Chair 56 and its operation will be described in greater detail hereinafter but it is to be noted that the back 58 of chair 56 can be reclined in any one of a large number of positions, as shown in FIG. 4, inasmuch as there is no detent structure for limiting the number of positions. The chair can rotate 360 degrees relative to chair support stand 66 to a finite number of positions by reason of a detent mechanism being utilized. Chair support stand 66 moves linearly along a chair support guide 76 in a manner that will hereinafter be described.

Figure 2:
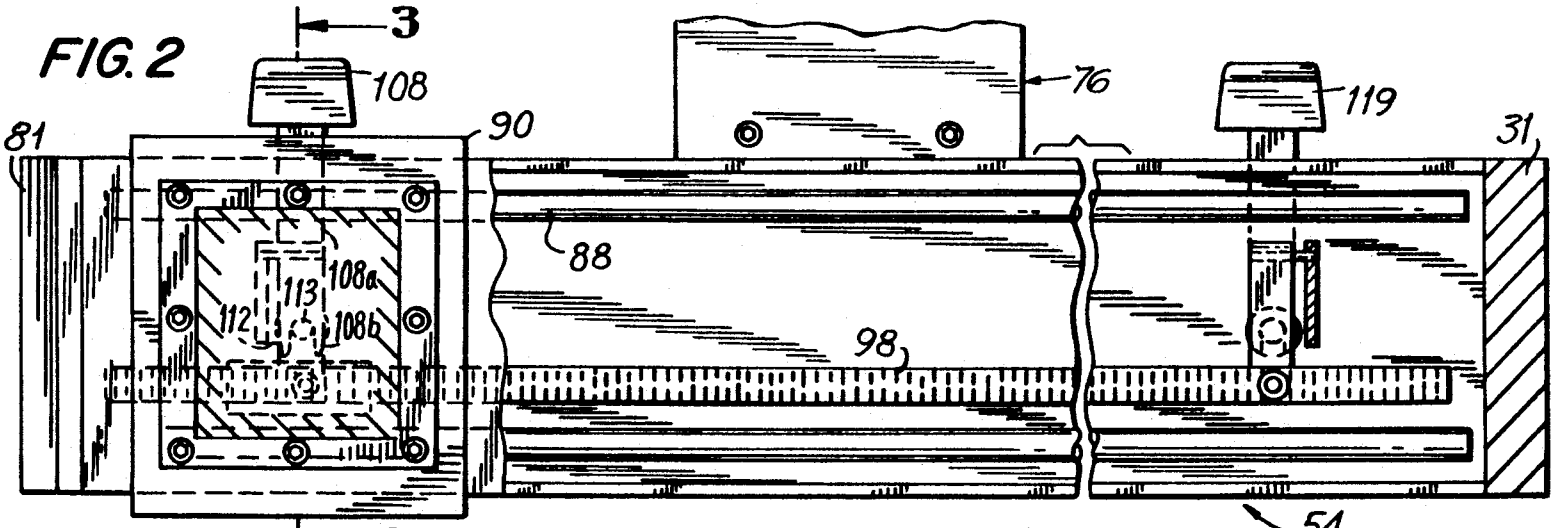
FIG. 2 is a sectional view taken substantially along the line 2—2 of FIG. 1.
Figure 3:
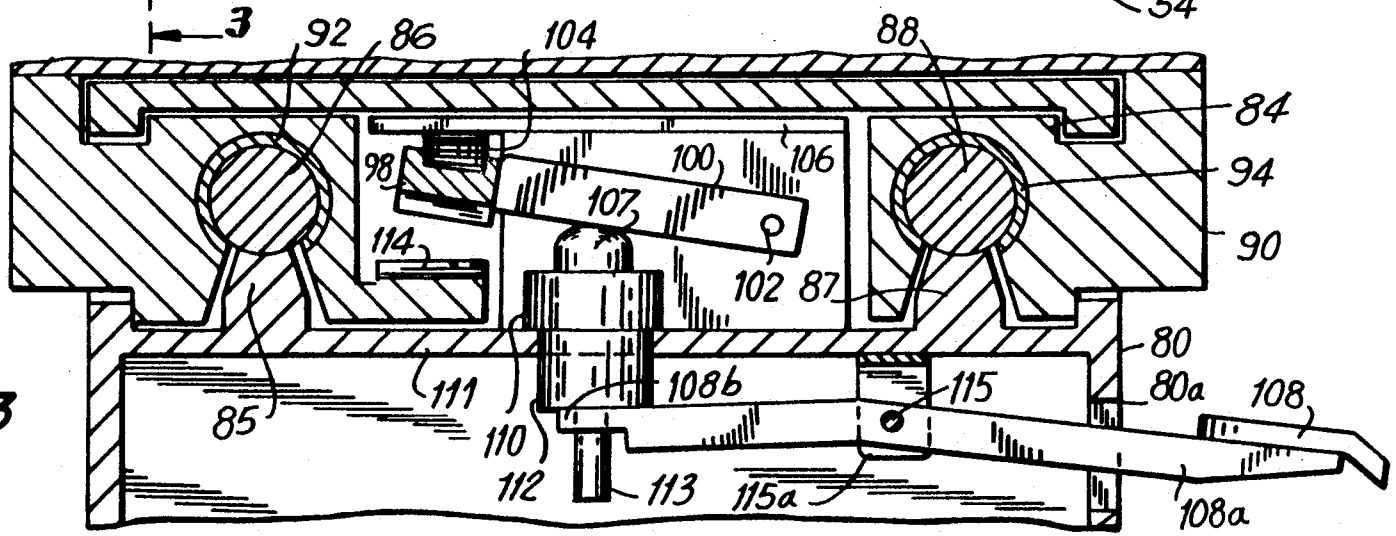
FIG. 3 is a sectional view taken substantially along the line 3—3 of FIG. 2.

Referring now to the powerhead support guide 54 and particularly FIGS. 1, 2 and 3, said powerhead support guide includes a base 80 which sits on the floor. Located at the opposite ends of base 80 are end plates 81. The front face 82 of base 80 includes a scale 83 on it with numerical notations so that the position of powerhead 12 along the position of powerhead support guide 54 can be visually preset and/or recorded.

Extending upwardly from base 80 are parallel support rails 85 and 87. The upper surfaces of rails 85 and 87 are concave.

Defining the uppermost portion of the powerhead support guide 54 is a cover plate 84 which is releasably attached to base 80. Extending transversely through the length of powerhead support guide 54 are a pair of bearing rods 86 and 86. A portion of bearing rod 86 contacts the upper concave surface of rail 85 (FIG. 3), while a portion of bearing rod 88 contacts the upper concave surface of rail 87. Bolts secure the bearing rods to the rails and to base 80.

Attached to and forming a part of the bottom of powerhead support stand 42 is a powerhead support plate 43 which is bolted to slide plate 57, slide plate 57 being affixed to a slide 90. Movable with slide 90 are bearing sleeves 92 and 94. The bearing sleeves only encircle a portion of the bearing rods, as can be seen in FIG. 3, with the unencircled portion of each bearing rod in contact with a rail. Sleeve 92 is in bearing relationship with bearing rod 86 and sleeve 94 is in bearing relationship with bearing rod 88. Sleeves 92 and 94 slide respectively along bearing rods 86 and 88 and by so doing move slide 90 and powerhead support stand 42 along the length of powerhead support guide 54.

A gear rack 98 which has its teeth in a downward direction extends substantially along the length of powerhead support guide 54 and is affixed to a lever 100. Lever 100 rotates about a rod 102 which is affixed to base 80. A compression spring 104 has one end abutting against a fixed spring rest 106 and the other end against the top surface of gear rack 98. Spring rest 106 is fixed relative to base 80.

The bottom surface of lever 100 abuts a pin 107 which slides relative to boss 110 with the boss being welded or otherwise affixed to shelf 111 of base 80. Pin 107 has a bottom section 112 which is of a larger diameter than the top section of the pin and can slide through shelf 111. Extending from the bottom of pin 107 is a rod 113. Movable with slide 90 is a shelf with a segmented gear rack 114 located atop said shelf.

A pedal 108 is affixed to a pedal lever **108*a* which is rotatable about a pin 115. Pin 115 is supported by U-shaped bracket 115*a* that is affixed to base 80. The portion of lever 108*a* furthest from pedal 108 includes a yoke 108*b* and the base 112 of pin 107 abuts the top of said yoke with rod 113 extending therethrough. Lever 108*a* extends through an opening 80*a* in base 80. Gear rack segment 114 is a narrow segment, has its teeth facing upwardly and engages with gear rack 98** whose teeth face downwardly in a manner that will hereinafter be described.

A second pedal 119 is provided on the opposite side of chair support guide 76 as is pedal 108 and has structure associated therewith (not shown in the drawings in detail) for controlling the position of slide 90 along the length of powerhead support guide 54 in the same manner that pedal 108 controls the position thereof.

Figure 5:
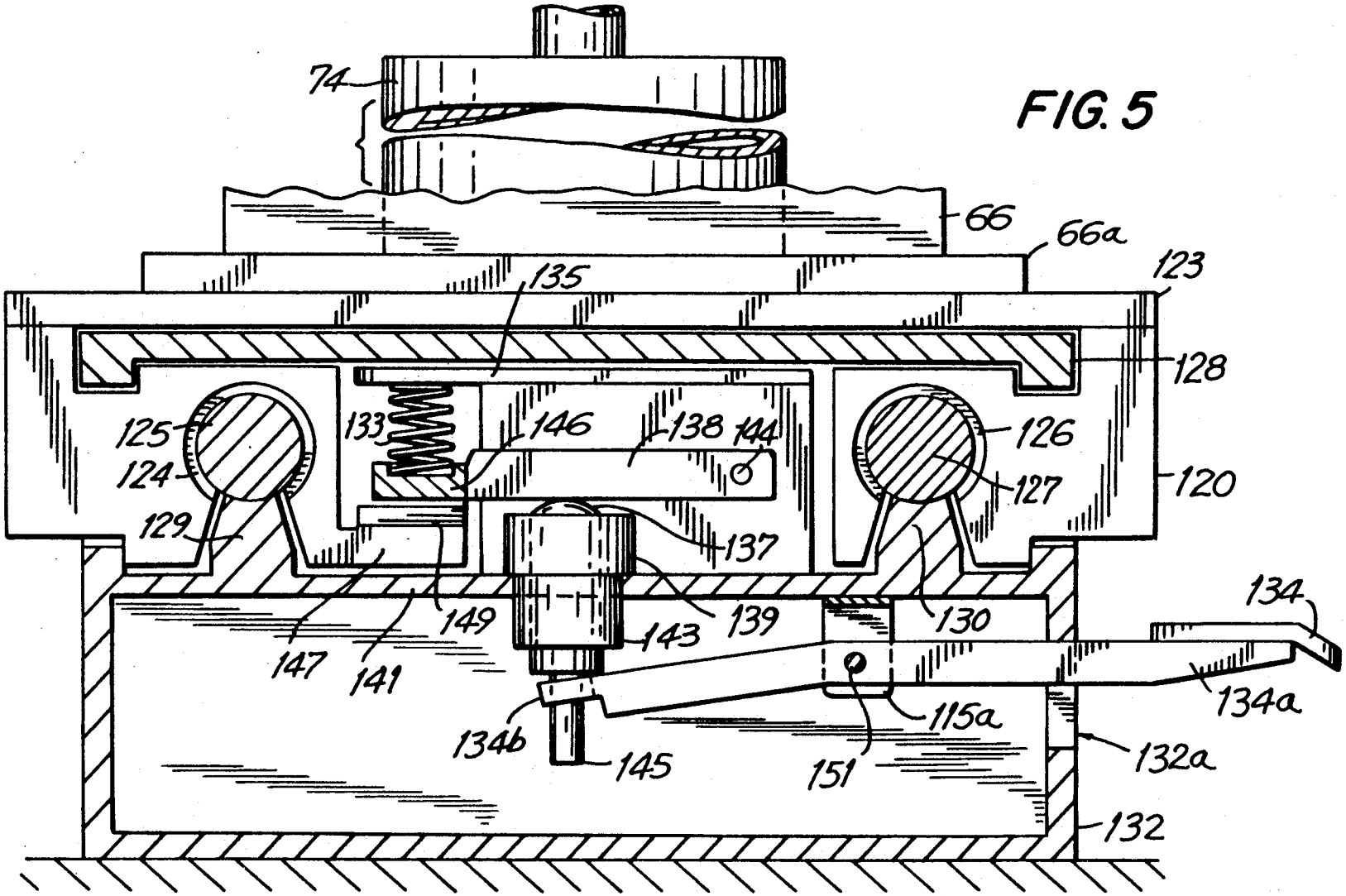
FIG. 5 is a sectional view taken substantially along the line 5—5 of FIG. 4.

In FIGS. 4 and 5 of the drawings, chair support stand 66 is shown having a base plate **66*a* which is affixed to a slide plate 123. Slide plate 123 is affixed to a slide 120 which slides along the length of chair support guide 76. Chair support guide 76 extends perpendicularly away from the center of powerhead support guide 54** while being affixed thereto.

Chair support guide 76 includes a base 132 and extending along the length of base 132 are bearing rods 125 and 127 which are supported in the same fashion as are bearing rods 86 and 88, as shown in FIG. 2.

Movable with slide 120 are bearing sleeves 124 and 126. Bearing sleeve 124 partially surrounds and is in slidable relation to bearing rod 125 and bearing sleeve 126 partially surrounds and is in slidable relationship with bearing rod 127. Support rails 129 and 131 extend upwardly from base 132 and each includes a concave surface that is in contact with the portions of bearing rods 125 and 127 not encircled by bearing sleeves for support purposes. A cover plate for base 132 is provided and identified by reference numeral 128 and can best be seen in FIGS. 1 and 5.

A gear rack 146, which has its teeth in a downward direction, extends substantially along the length of chair support guide 76 and is affixed to a lever 138. Lever 138 rotates about a rod 144 which is affixed to base 132. A compression spring 133 has one end abutting against a fixed spring rest 135 and the other end against the top surface of gear rack 146. Spring rest 135 is fixed relative to base 132.

The bottom surface of lever 138 abuts a pin 137 which slides relative to a boss 139, with the boss being welded or otherwise affixed to a shelf 141 of base 132. Pin 137 has a bottom section 143 which is of a larger diameter than the top section of the pin and can slide through shelf 141. Extending from the bottom of pin 137 is a rod 145. Movable with slide 132 is a shelf 147 with a segmented gear rack 149 located atop said shelf.

A pedal 134 is affixed to a pedal lever **134*a* which is rotatable about a pin 151. Pin 151 is supported by U-shaped bracket 151*a* that is affixed to base 132. The portion of lever 134*a* furthest from pedal 134 includes a yoke 134*b* and the base 143 of pin 137 abuts the top of said yoke with rod 145 extending therethrough. Lever 134*a* extends through an opening 132*a* in base 132**.

Gear rack segment 149 is a narrow segment, has its teeth facing upwardly and engages with gear rack 146 whose teeth face downwardly in a manner that will hereinafter be described.

While two pedals are disclosed for controlling the position of powerhead 12 along the length of powerhead support guide 54, only one such pedal is used to control the position of chair 56 along the length of chair support guide 76.

It is to be appreciated that scale markings 150 are located on opposed surfaces of chair support guide base 132, as can partially be seen in FIG. 1, and provide a visual indication of the location of the chair support stand on chair support guide 76.

The muscle exercise and rehabilitation apparatus 10 as encompassed by powerhead 12 and controller 36 operates in the manner described in U.S. Pat. No. 4,691,694. Computer 30 and keyboard 34 are for data acquisition purposes.

If we assume for purposes of illustration that the patient is to have his right leg and, more specifically, the right knee rehabilitated and exercised he will sit in the chair and straps 64 and 62 will be placed around his torso while strap 65 is utilized to strap the person's right leg to the chair.

The physical therapist, based on his knowledge of the patient's physiology, will raise or lower the chair to a desired height and, in addition, move the chair back to a desired position and rotate the chair to the desired orientation. The therapist will depress pedal 134, causing pin 137 to elevate so that lever 138, which rotates in a clockwise direction, compresses spring 133 disengaging rack 146 from gear rack 149. As a consequence thereof, slide 120 will be able to slide under a force applied by a physical therapist along rods 125 and 127 until a desired position is reached. The rails associated with bearing rods 125 and 127 will support the rods to prevent the rods from deflecting. When it is desired to cease any further movement of slide 120, pedal 134 will no longer be depressed so that rack section 144 will engage gear rack 149 under the bias of compression spring 133.

If the therapist knows the desired position for the patient, he/she can move slide 120 to that position by stopping the slide at the appropriate scale marking 150. Alternatively, the therapist can use his/her professional judgment to move slide 120 to the preferred position.

In a similar fashion, the therapist will depress either of pedals 119 or 108 compressing spring 104 (FIG. 3) and elevating rack 98 which is affixed to lever 100 so that the rack 98 is no longer engaged with gear segment 114. The therapist will then move slide 90 along rods 86 and 88 until they are in the appropriate position adjacent the outside portion of the right leg of the patient. The pedal will then be released, causing the lever 100 under the bias of spring 104 to rotate in a counterclockwise direction so that gear rack 98 engages the teeth of gear rack 114 thereby preventing lateral movement of slide 90.

The height of powerhead 12 will be adjusted to the desired position by use of lever arm and clamp 50 and, in a similar fashion, the rotational orientation of the powerhead will be controlled by use of lever arm and clamp 48. Finally, the tilt of the powerhead will be adjusted by means of lever arm and clamp 52.

The goal of the therapist is to align the axis of the powerhead with the axis of rotation of the patient's limb which is being rehabilitated while at the same time making sure that the patient is comfortable and safe.

Of course, the position and orientation of the chair can be fixed prior to fixing the position and orientation of the powerhead or a combination thereof. The patient will then exercise and rehabilitate his right leg and after the exercise is completed, if it is desired to then exercise the left leg, strap 65 will be released and placed about the thigh of the person's left leg. It is to be appreciated that the means for securing straps 64, 62 and 65 are conventional and can include conventional VELCRO, hooks and loops or any other appropriate fastening means.

Fixture 16 and cuff 20 will be removed from gearbox output shaft 14 shown in FIG. 1 and attached to the gearbox output shaft on the other side of powerhead 12 of FIG. 1. Pedal 119 or 108 will be depressed causing gear rack 98 to move out of engagement with gear rack 114, at which time the therapist will move slide 90 such that the powerhead is positioned outside the person's left leg (or, from the position partially shown in dotted lines in FIG. 7, to the position shown in solid lines). Pressure on the depressed pedal will be released locking slide 90 in place. If desired and necessary, the orientation and location of the chair can be further adjusted. The cuff will be attached to the patient's left ankle, allowing him to exercise and rehabilitate his left leg without having to first dismount from the chair after having completed his exercise and rehabilitation on his right leg.

As can be seen in FIG. 7, there are a plurality of positions of chair 56 relative to the powerhead such that an optimal position for each patient can be obtained.

It is important to note that chair 56 is ergonomically designed and incorporates lumbar and lateral support for the patient as well as providing 360 degrees of rotation. By enabling the chair to be rotated for a full 360 degrees of seat rotation, the physical therapist can position the patient at numerous angles to the powerhead.

By having scale notations on powerhead support guide 54 and scale settings on chair support guide 76, after a patient has utilized the muscle exercise and rehabilitation apparatus, the therapist can input into the computer the scale settings for a particular patient so that when the patient returns for further exercise and rehabilitation, the powerhead and chair can be set to the correct positions along their respective support guides.

It is, of course, to be appreciated that, while reference has been made herein to a muscle exercise and rehabilitation apparatus utilizing a powerhead and controller, as illustrated in U.S. Pat. No. 4,691,694, this is for purpose of illustration and not limitation. The present invention can be used with other types of muscle exercise and rehabilitation units which regulate exercise and rehabilitation of a patient when seated in a patient chair.

Figure 8:
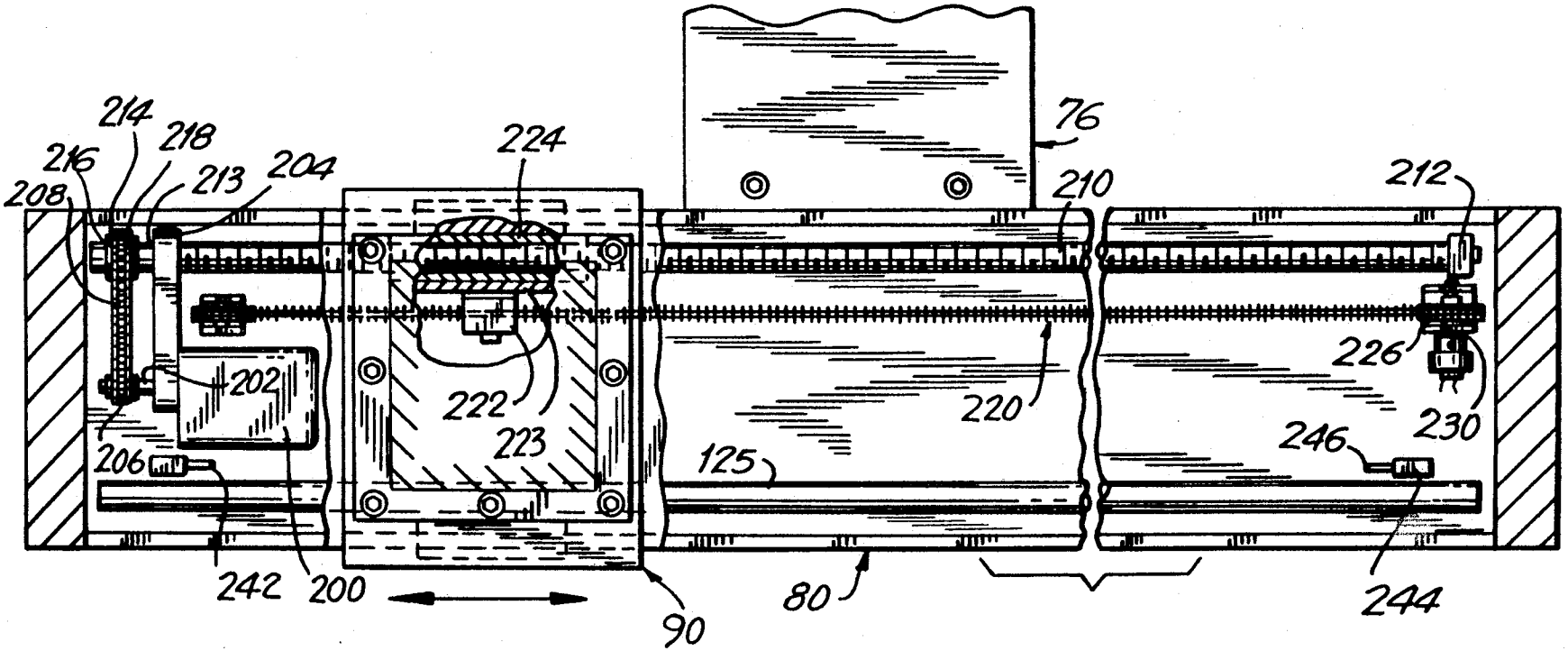
FIG. 8 is a sectional view through the powerhead support guide showing an alternative embodiment of the present invention.
Figure 9:
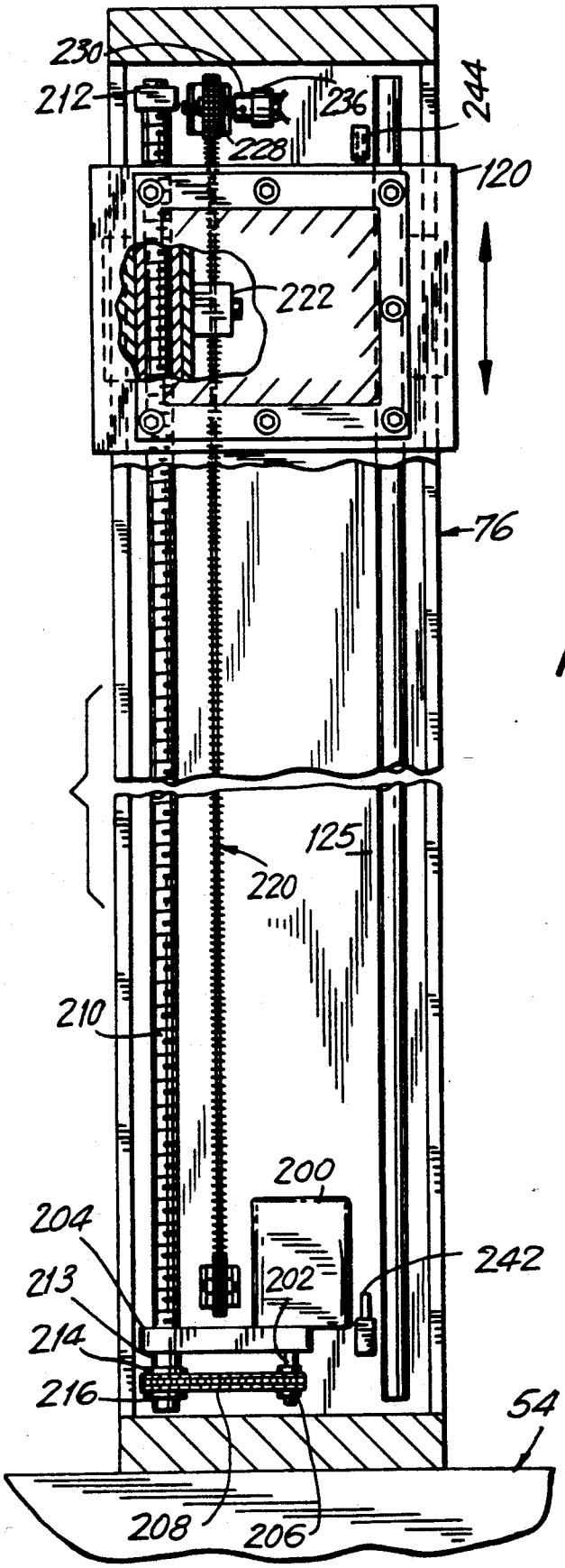
FIG. 9 is a sectional view through the chair support guide showing an alternative embodiment of the present invention.
Figure 10:
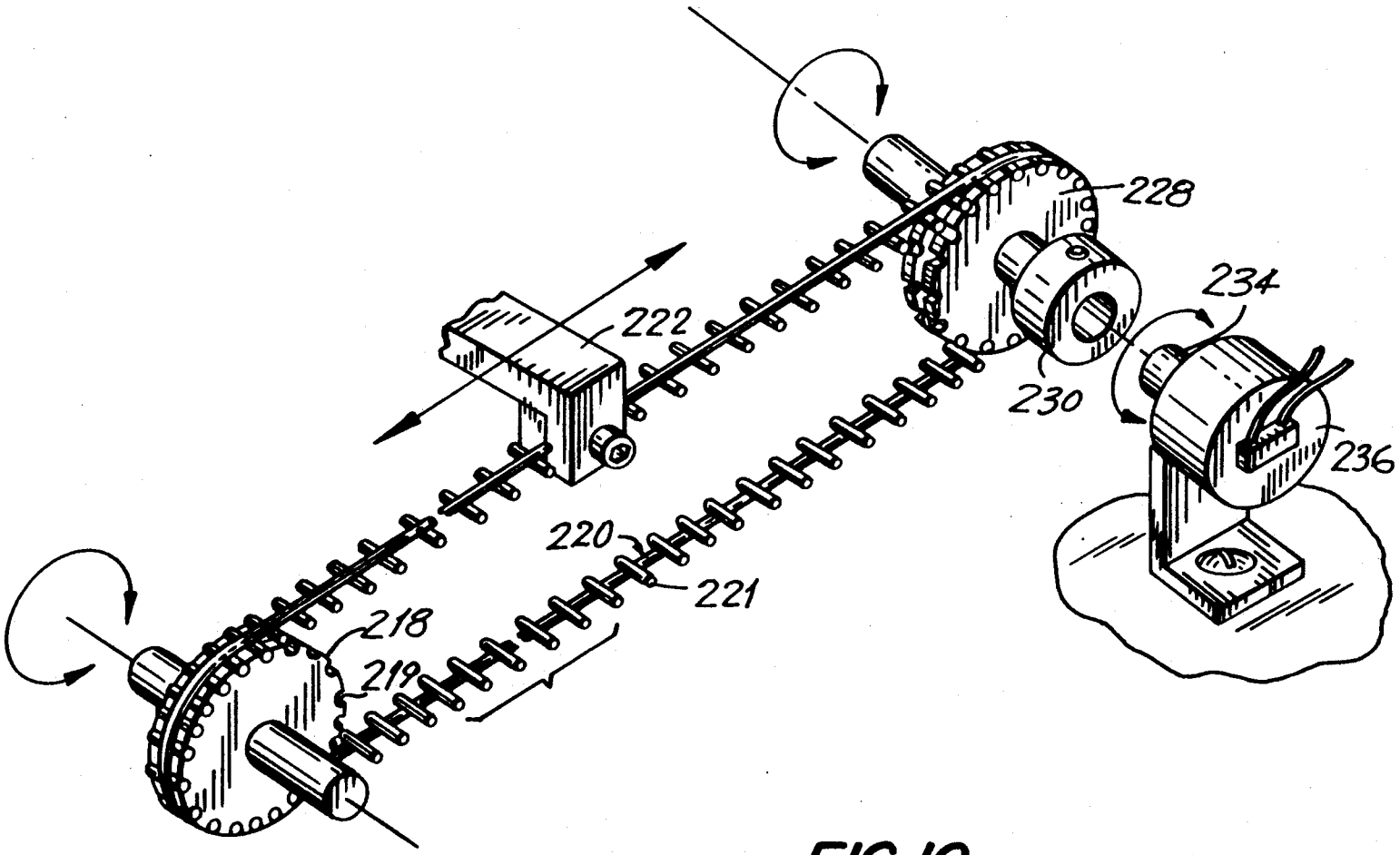
FIG. 10 is a perspective, partially exploded view of the position sensing means for the alternative embodiment of the present invention.

In the embodiment of the invention shown in FIGS. 8, 9 and 10, an electric motor 200 is affixed to base 80 and has an output shaft 202 which extends in a bearing relation through a mounting plate 204 which is affixed to base 80. Mounting plate 204 includes an opening through which shaft 202 extends and located on the distal end of shaft 202 is a gear 206. In engagement with gear 206 is a timing chain 208. A rotatable lead screw 210 is provided and the right end, as viewed in FIG. 8, is journaled in a bearing block 212 which is affixed to base 80. The left end of lead screw 210 is journaled through mounting plate 204 and extends therethrough and terminates in a non-threaded portion 213. Rotatable with non-threaded portion 213 is a gear 214, and timing chain 208 is in engagement therewith. A pulley bracket 216 is affixed to base 80 and rotatably supports a pulley 218. As can be seen in FIG. 10, pulley 218 includes on its periphery serrations 219 which are parallel to each other and parallel to the axis of rotation of the pulley. A timing chain 220 includes spaced apart locking elements 221 which can fit into serrations 219 to prevent relative motion between the portion of the timing chain encircling the pulley and the pulley. Timing chain 220 is wrapped around pulley 218 so that the locking elements on the timing chain which are in contact with the pulley are each received within a serration.

Timing chain 220 is affixed to clamp 222 so that when the clamp moves, as shown by the arrow in FIG. 10, the timing chain likewise moves. Clamp 222 is secured to a securing member 223 which is affixed to a sleeve 224 which sleeve has internal threads and is in threaded engagement with external threads of lead screw 210. Threaded sleeve 224 is affixed to guide 90 such that when the threaded sleeve moves in a longitudinal direction along the length of lead screw 210, the guide similarly moves in a longitudinal direction along the length thereof. Because timing chain 220 is affixed to clamp 222, when the clamp moves along with sleeve 224 the timing chain likewise is pulled in the direction of such movement.

Located at the right end of powerhead support guide 54 is a further pulley support 226 which supports a pulley 228 for rotation. Pulley 228 is identical to pulley 218. Rotatable with pulley 228 is a lock nut 230 having an internal opening through which a post 234 of a potentiometer 236 extends. Post 234 of potentiometer 236 rotates with lock nut 230 and pulley 228.

Limit switch 240 having an actuator post 242 is located adjacent the left end of base 80 and a further limit switch 244 having an actuator post 246 is located adjacent the opposite end of base 80.

As a safety precaution, if slide 90 moves too far toward either end of powerhead support guide 54, one of the limit switches' actuator posts will be depressed, terminating energy to the motor so that all further movement of slide 90 will cease. It is to be appreciated that in the embodiment of the invention shown in FIG. 8, gear locking means is not provided as this is not necessary since, when the motor is de-energized, the longitudinal movement of slide 90 is prevented by reason of lead screw 210 not rotating.

In FIG. 9 of the drawings, the identical structure which is used to move the slide 90 along the length of powerhead guide 54 is depicted for controlling the position of the chair along the length of chair guide 76 and, accordingly, the reference numerals used in FIG. 9 are the same for identical elements that appear in FIG. 8.

The cable and pulley structure shown in FIG. 10, while discussed in conjunction with positioning the powerhead support stand, is identical to the structure for positioning the chair support.

It is to be noted that electric motor 200 is a reversible direction electric motor and controls are provided to control the actuation and direction of rotation thereof. When it is desired to move slide 90 to a particular location, motor 200 is energized, rotating shaft 202, gear 206, timing chain 208, gear 214 and lead screw 210. This causes threaded sleeve 224, which is constrained from rotation, to move along the length of lead screw 210 together with slide 90, powerhead support stand 42 and powerhead 12 until it reaches the desired location. As the powerhead support stand is moved, timing chain 220 is likewise moved, causing pulley 228 to rotate and causing rotation of post 234 of potentiometer 236, changing the resistance of the potentiometer. Knowing the change in the resistance of the potentiometer and how it corresponds to the location of slide 90 along the length of the powerhead support guide 54, it is relatively simple to move the powerhead support stand to a selected and desired position and to determine the position of the powerhead guide at any moment. In a similar fashion, the position of the chair support stand is controlled and regulated.

It is, of course, to be appreciated that one can preposition the location of the powerhead support stand and chair support stand by actuation of the respective electric motors before the patient is seated on the chair, provided, of course, this pre-positioning does not interfere with the patient's access to the chair. The correct position of the powerhead and chair for a particular patient can be stored in the computer and when the patient presents himself for a physical therapy session, the therapist will know the correct position for that particular patient by merely bringing up the patient's historical file on the computer screen. This information can then be used to move the powerhead and chair to the desired position.

Having described specific preferred embodiments of the invention with reference to the accompanying drawings, it will be appreciated that the present invention is not limited to those precise embodiments and that various changes and modifications can be effected therein by one of ordinary skill in the art without departing from the spirit or scope of the invention as defined in the appended claims.

What is claimed is:

1. Muscle exercise and rehabilitation apparatus comprising:

(a) a patient chair having a first side and a second side, (b) power means for the exercise and rehabilitation of a patient seated in the patient chair, (c) means for selectively moving the power means between a position adjacent the first side of the patient chair and the second side of the patient chair along a first linear path, (d) means for controlling the position of the power means so that said power means can be selectively raised and lowered, rotated about a vertical axis passing through the power means and tilted about a horizontal axis passing through said power means, (e) means for moving said patient chair along a second linear path toward and away from the first linear path, and (f) means for raising and lowering the patient chair and for rotating the patient chair so that a patient seated in the patient chair can be positioned in a plurality of orientations relative to said power means.

2. Muscle exercise and rehabilitation apparatus according to claim 1 wherein said first and second linear paths are perpendicular to each other.

* * * * *